United States Patent [19]

Heisler

[11] Patent Number: 4,959,944

[45] Date of Patent: Oct. 2, 1990

[54] SEPARATING, FEEDING, AND METERING OF A RANGE OF COVERS WITHOUT THE NEED FOR INTERMEDIATE ADJUSTMENT

[76] Inventor: Raymond A. Heisler, 657 Dakota Trail, Franklin Lakes, N.J. 07417

[21] Appl. No.: 437,833

[22] Filed: Nov. 17, 1989

[51] Int. Cl.[5] ..... B65B 7/28; B67B 3/062

[52] U.S. Cl. ..... 53/313; 53/316; 221/212

[58] Field of Search ..... 53/313, 314, 315, 316, 53/307, 309, 367; 221/211, 297, 212; 271/165, 102

[56] References Cited

U.S. PATENT DOCUMENTS

| | | | |
|---|---|---|---|
| 3,332,209 | 7/1967 | Knudsen | 53/313 |
| 3,350,842 | 11/1967 | Renish | 53/316 |
| 3,460,314 | 8/1969 | Keas | 53/316 X |
| 3,509,682 | 5/1970 | Logemann | 53/307 X |
| 3,924,384 | 12/1975 | Kinney | 53/314 X |
| 4,038,807 | 8/1977 | Beardsley et al. | 53/307 X |
| 4,122,649 | 10/1978 | Sawvel | 53/314 X |
| 4,312,172 | 1/1982 | Fisher et al. | 53/316 X |
| 4,601,160 | 7/1986 | Heisler | 53/316 X |
| 4,683,706 | 8/1987 | Harper | 53/316 X |
| 4,703,607 | 11/1987 | Pröpper et al. | 221/211 X |

*Primary Examiner*—Horace M. Culver
*Attorney, Agent, or Firm*—Patrick J. Pinto

[57] ABSTRACT

An improved apparatus for separating a preformed cover from an inclined nested stack of covers, advancing and simultaneously rotating said cover from a substantially vertical disposition to a substantially horizontal disposition by means of a transfer chute, said cover advancing to a placing position, by means of gravity, on an inclined chute. Said cover being placed on a matching container, said container advancing on a process conveyor. Said apparatus adapted for feeding and placing a range of covers of like design without the need for intermediate adjustments.

24 Claims, 7 Drawing Sheets

SEPARATING, FEEDING, AND METERING OF A RANGE OF COVERS WITHOUT THE NEED FOR INTERMEDIATE ADJUSTMENT

BACKGROUND OF THE INVENTION

1. Field of the Invention

With respect to the art, as established in and by the U.S. Patent and Trademark Office, this invention is believed to be found in the general class entitled "Packaging" and more particularly "closing of a preformed container with a preformed closure".

2. Description of the Prior Art

As far as it is known many devices exist for the separating, feeding and the placing of preformed covers on preformed containers. One example of a prior art device is my U.S. Pat. No. 4,601,160 issued on July 22, 1986. U.S. Pat. No. 4,601,160 and other devices commercially available require that the equipment be adjusted for each and every size of performed cover. The present invention does not require intermediate adjustments for variation in cover diameter after an initial adjustment has been made for a particular cover type or design.

SUMMARY OF THE INVENTION

This invention may be summarized, at least in part, with reference to its objects. It is an object of this invention to provide a novel and improved apparatus for removing the lowermost cover from an inclined nested stack and placing this cover on a gravity chute and guiding the cover to a placing position to be affixed thereafter to an advancing preformed container.

It is a further object of this invention to provide and it does provide a novel and improved apparatus for separating the lowermost cover from an inclined nested stack and placing this lowermost cover on a preformed container by way of an inclined chute. The apparatus is capable of feeding and placing various diameter covers within a selected range without intermediate adjustments for differences in diameter.

It is still a further object to provide and it does provide an apparatus for feeding, placing, metering, and applying a cover to a preformed traveling container. This apparatus being capable of feeding ferrous and non-ferrous metal covers as well as plastic covers.

It is still another object to provide and it does provide a novel and improved apparatus for separating, feeding and applying a preformed cover to a traveling preformed container. This apparatus having a minimum of moving parts.

In addition to the above summary, the following disclosure is detailed to insure adequacy and aid in the understanding of this invention. This disclosure, however, is not intended to cover each new and inventive concept, not matter how it may later be disguised either by variations in form or additions by further improvements. For this reason, there has been chosen specific embodiments of an apparatus for separating, feeding, and metering of a range of preformed covers without the need for intermediate adjustments. This apparatus is adapted for use with existing filled-container conveying equipment. These specific embodiments have been chosen for the purpose of illustration and description, as shown in the accompanying drawings wherein:

BRIEF DESCRIPTION OF THE DRAWING

In the following description and in the claims, various details are identified by specific names for convenience. These names are intended to be generic in their application. The corresponding reference characters refer to like members throughout the several figures of drawings.

The drawings accompanying, and forming a part of this specification disclose certain details of construction associated with a preformed cover feeding and placing apparatus. These details are for the purpose of explanation, but structural details may be modified without departure from the concept and principles of the present invention. It is anticipated that this invention may be incorporated in forms other than as shown.

EMBODIMENT OF FIGS. 1 AND 2

Figure 1:
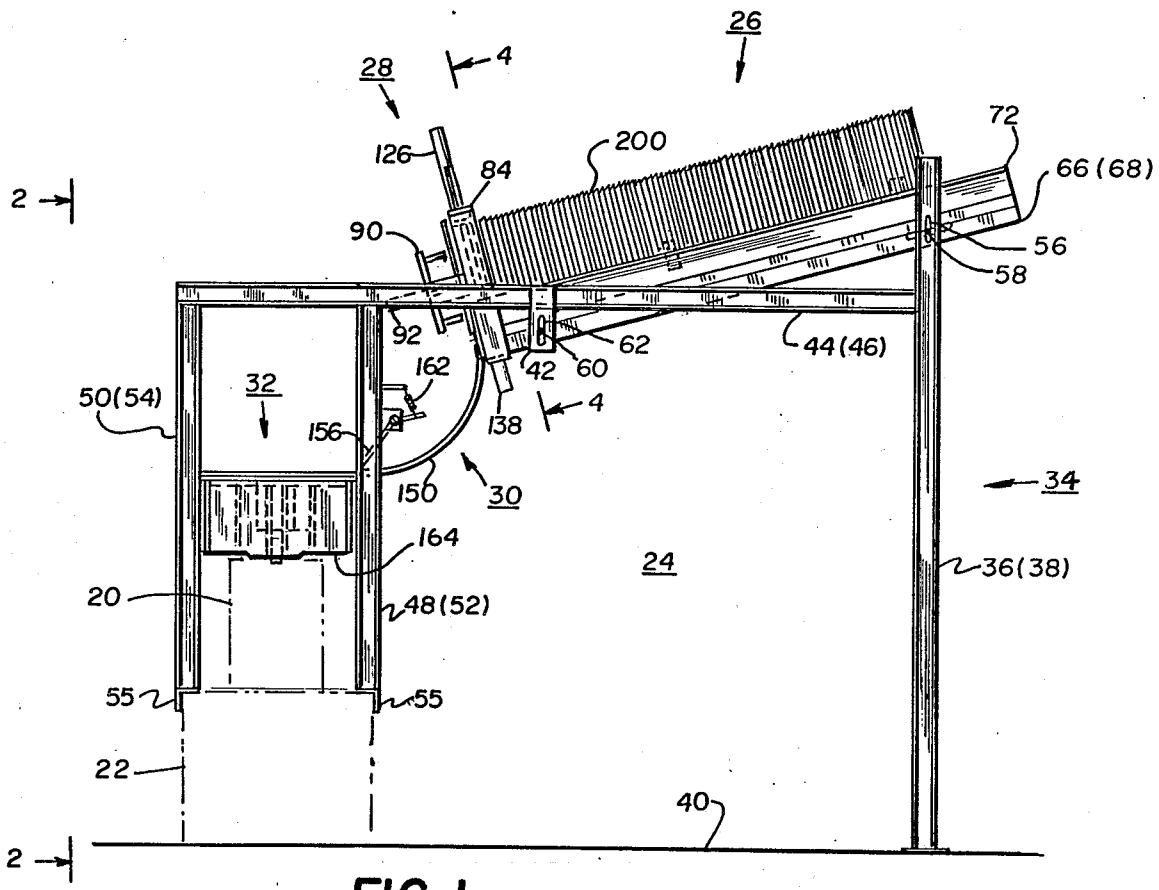
FIG. 1 represents a front elevational view, partly diagrammatic, showing the arrangement for accommodating a nested stack of covers on an inclined hopper and the relationship of this hopper to a process conveyor carrying a preformed filled container.

Referring to FIG. 1, a preformed filled container, shown in dashed outline, and identified as 20 is carried and advanced on a process conveyor 22, which is also shown in dashed outline. In the preferred embodiment, the process conveyor 22 provides a locating means and support for one portion of the cover separating, feeding, and placing apparatus, generally identified as 24. This apparatus 24 is comprised of individual assemblies, including an inclined hopper for nested covers generally identified as 26; a cover separating assembly, generally identified as 28; a transfer chute assembly, generally identified as 30; and an inclined gravity chute and placing assembly, generally identified as 32. This inclined chute and placing assembly 32 may also be seen in FIG. 2. The hopper assembly 26, separating assembly 28, transfer chute assembly 30, and inclined chute assembly 32 are all mounted to a welded steel main frame assembly 34. The main frame assembly 34 includes a pair of vertical leg members 36 and 38 which are secured to the floor 40 of a processing facility by a suitable means. A Pair of bracket members 42 are attached to each of a pair of horizontal members 44 and 46 of frame 34. Vertical leg members 48, 50, are welded to the horizontal member 44 at an end distal to leg member 36. Similarly vertical legs 52 and 54 are welded to horizontal leg 46. Legs 48, 50, 52 and 54 are secured to the process conveyor 22 by a suitable means, such as a pair of steel angle members 55.

An elongated aperture 56 is provided at the upper end of each of the vertical leg members 36 and 38. These apertures are positioned substantially in-line to carry a first elongated cross-shaft 58. The elongated apertures 56 provide for vertical adjustment of the cross-shaft 58. A second cross-shaft 60 is carried by an elongated aperture 62 provided in each of the brackets 42. Elongated apertures 62 allow vertical adjustment for the cross-shaft 60. Each of the cross-shafts 58 and 60 are adjusted and positioned by a pair of threaded adjusting screws, not shown, to provide an incline angle between 15 and 20 degrees with respect to the horizontal. Transverse positioning is provide by commercially available clamp collars 64.

The hopper assembly 26 is carried on the first cross-shaft 58 and second cross-shaft 60. A first elongated rail member 66 and a second elongated rail member 68 are carried in spaced relationship by cross-shafts 58 and 60. Commercially available clamp collars 70 are used to maintain the position of the rails 66 and 68 on the cross shafts 58 and 60, as may be seen particularly in FIG. 2. An elongated formed side guide member 72 is fastened to each of the rails 66 and 68.

EMBODIMENTS OF FIGS. 4 AND 5

Figure 4:
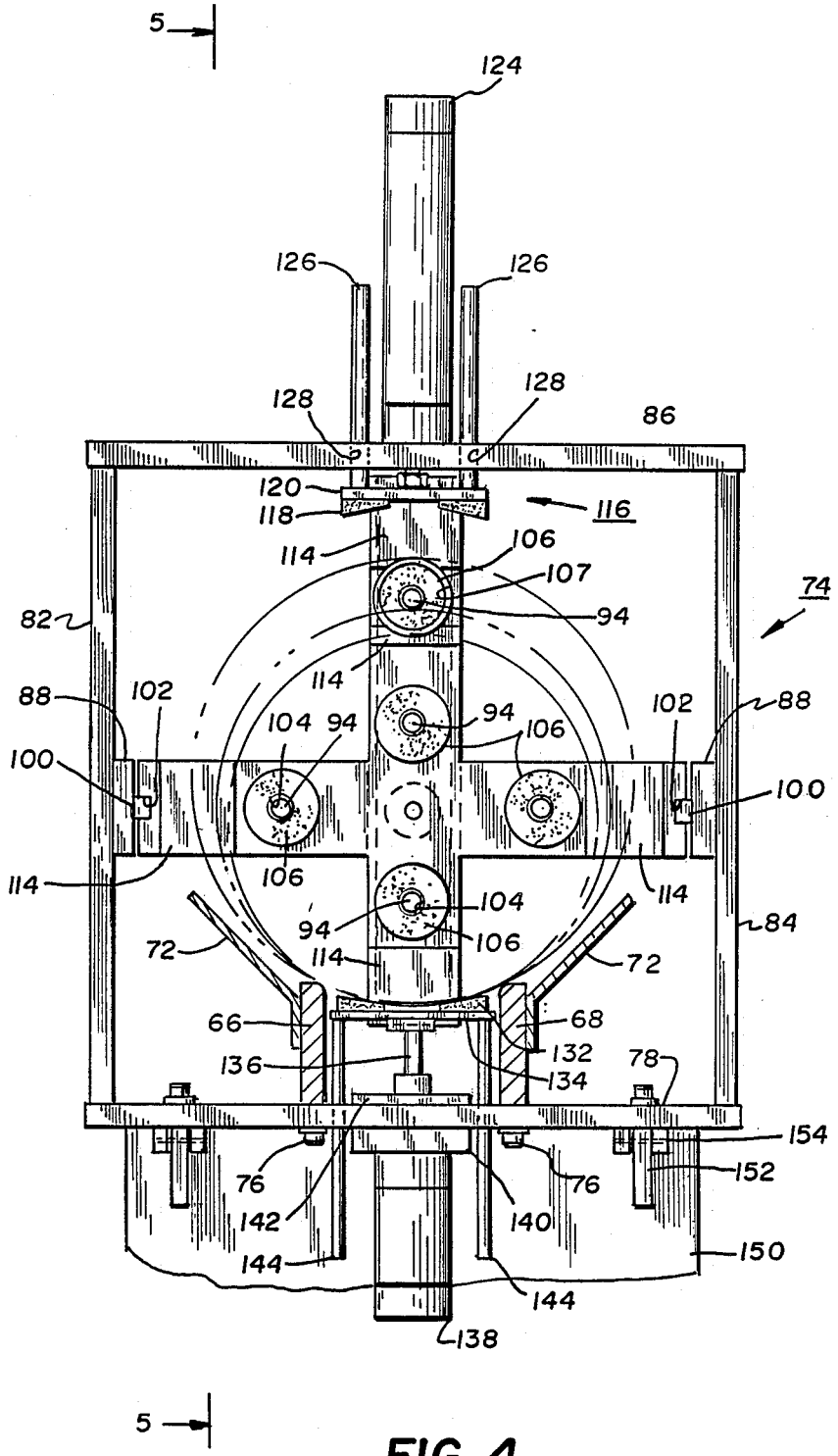
FIG. 4 represents a fragmentary sectional view of a separating mechanism for removing the lowermost ferrous metal cover from an inclined nested stack, this view is in an enlarged scale and taken along line 4—4 of FIG. 1.

Referring to FIG. 4, the cover separating assembly 28 comprises a rectilinear frame assembly, generally identified as 74, fastened to each of the first and second elongated rails 66 and 68, by means of suitable fasteners 76. This frame assembly 74 comprises a pair of elongated rectangular cross-bars 78. These cross-bars are held in spaced relationship forming an elongated slot 80 there between. A first side bar 82 and a second side bar 84 are fastened to the cross-bars 78. An elongated upper cross-member 86 is fastened to the side bars 82 and 84 distal the cross-bars 78, completing the rectilinear frame.

Figure 5:
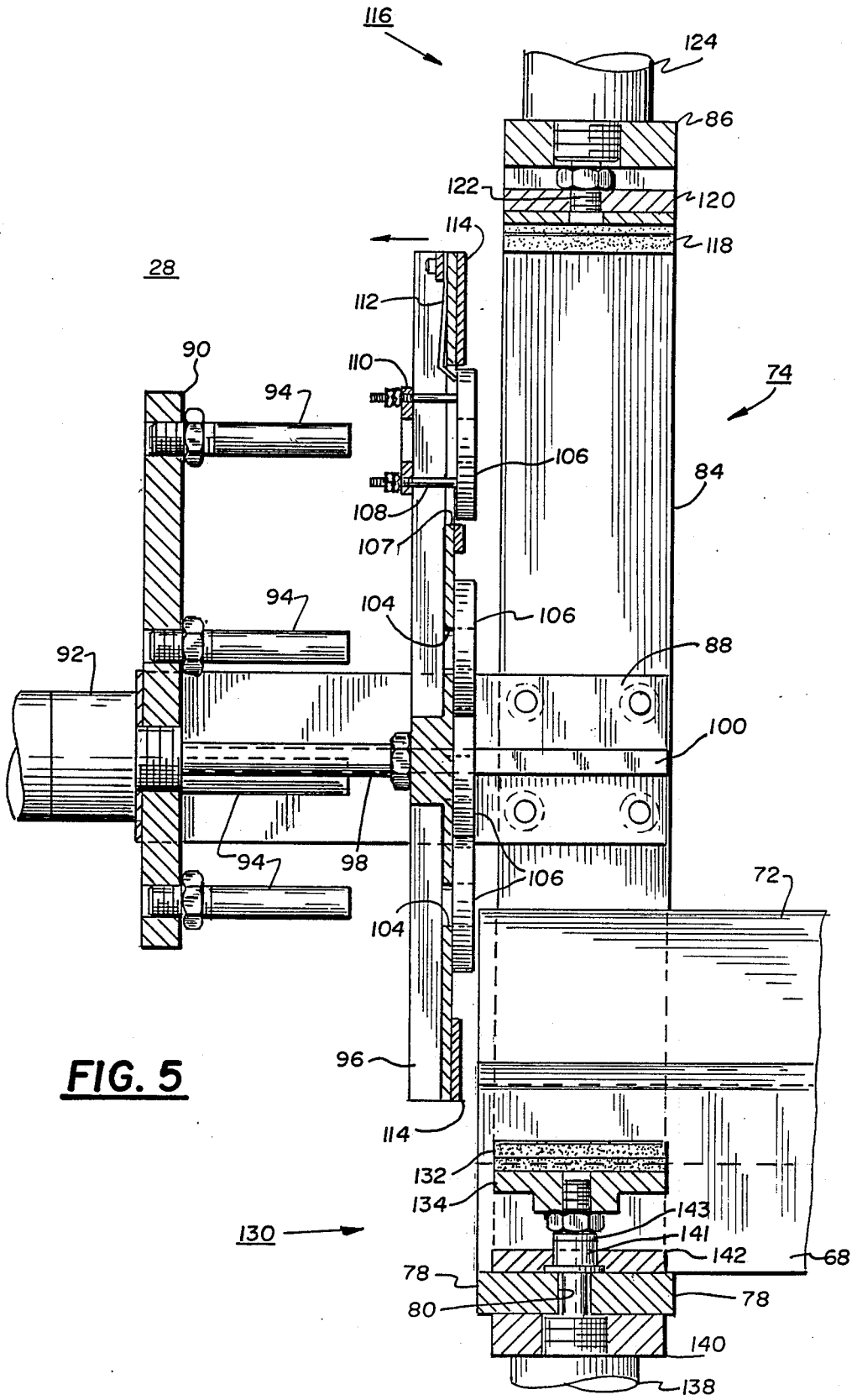
FIG. 5 represents a sectional view of the apparatus of FIG. 4 in an enlarged scale, this view taken along line 5—5 of FIG. 4.

Referring now to FIG. 5, each of a pair of support members 88 are fastened, at a selected position, to each of the side bars 82 and 84. A cruciformed shaped mounting plate 90 is fastened to each of the support members 88 at the end opposite the side bars 82 and 84. A linear actuator 92 is mounted in and on the shaped mounting plate 90 by a suitable means, such as by a nose mounting arrangement, but other suitable mounting may be used. A plurality of stripper pins 94 are selectively mounted in and on the shaped mounting plate 90. Each of the stripper pins 94 is preferably mounted by a secured threaded connection to allow adjustments for variations in length of the pins 94. Each of these pins 94 is made of a non-ferrous material. The reason for which, will become apparent later.

A cover separating member 96, having a more or less cruciform shape is mounted to the shaft 98 of the linear actuator 92 by a suitable means, such as a threaded connection. Anti-rotational guidance for the cover separating member 96 is provided by guide members 100 mounted to the support members 88, cooperating with mating grooves 102, formed in the separating member 96.

A plurality of apertures 104 are selectively formed in and through the separating member 96. These apertures 104 are located to be in substantial alignment with the stripper pins 94 and are sized to provide a clearance fit with the stripper pins 94. A plurality of disk magnets 106 are mounted in concentric alignment with apertures 104 and stripper pins 94. The quantity of Magnets 106 and associated stripper pins 94 is a matter of design selection. Referring now to FIG. 5, it can be seen that the uppermost magnet 106 is adapted to retract into an aperture 107 in and through the separating member 96. This upper-most magnet 106 is fastened to guide pins 108. These guide pins 108 are slideable in a mounting block 110. A biasing means 112, such as a flat spring, is provided to urge the uppermost magnet 106 to an outward position. A plurality of spacer pads 114 are removably mounted to the separating member 96 at selected positions.

Referring now to FIG. 4, an upper clamp 116 includes a shaped elastomer pad 118 carried on a backing plate 120. The backing plate 120 is secured to the extensible rod 122 of a first linear actuator 124. The first linear actuator 124 is mounted to the upper cross member 86. Anti-rotation guidance for the upper clamp 116 is provided by a pair of guide rods 126 attached to the backing plate 120. Guidance for these rods 126 is provided by through apertures 128 in the cross member 86.

A lower clamp, generally identified as 130, is located directly opposite the upper clamp 116 and secured to cross bars 78. A shaped elastomer pad 132 is carried on a lower backing plate 134. The backing plate 134 is secured to the extensible rod 136 of a second linear actuator 138. The second linear actuator 138 is secured to block 140. The second linear actuator 138 and block 140 assembly is secured to the cross member 78 by a clamp plate 142. The extending rod 136 freely passes through slot 80. Anti-rotational guidance is provide by a pair of guide rods 144 attached to the backing plate 134. These guide rods 144 also extend into and through the slot 80 of the cross member 78. The block 140 has a rod bushing 141 and a elastomer bumper 143 to guide the rod 136 as well as limit the downward stroke of lower clamp 130.

A transfer chute 30 is supported by the cross member 78 and may be seen more clearly in FIG. 4. This transfer chute 30 comprises a curved plate 150 which has a pair of hinge blocks 152 selectively mounted to its upper portion. These blocks 152 are connected by a hinged arrangement with a pair of furcated blocks 154 which are also secured to cross members 78 by a suitable means.

EMBODIMENT OF FIG. 3

The lower portion of the transfer chute 30 extends horizontally, beyond the vertical leg members 48 and 52. Attached to leg members 48 and 52 is a pivoting gate 156. This gate 156 is fastened to a pivot shaft 158. The pivot shaft 158 is journaled in a pair of mounting blocks 160. Each one of the mounting blocks 160 is carried on the vertical legs 48 and 52. A tensioning means 162 is provided to urge the gate 156 against the transfer chute 150. This gate 156 may also be seen in FIG. 1 in a reduced scale.

Figure 2:
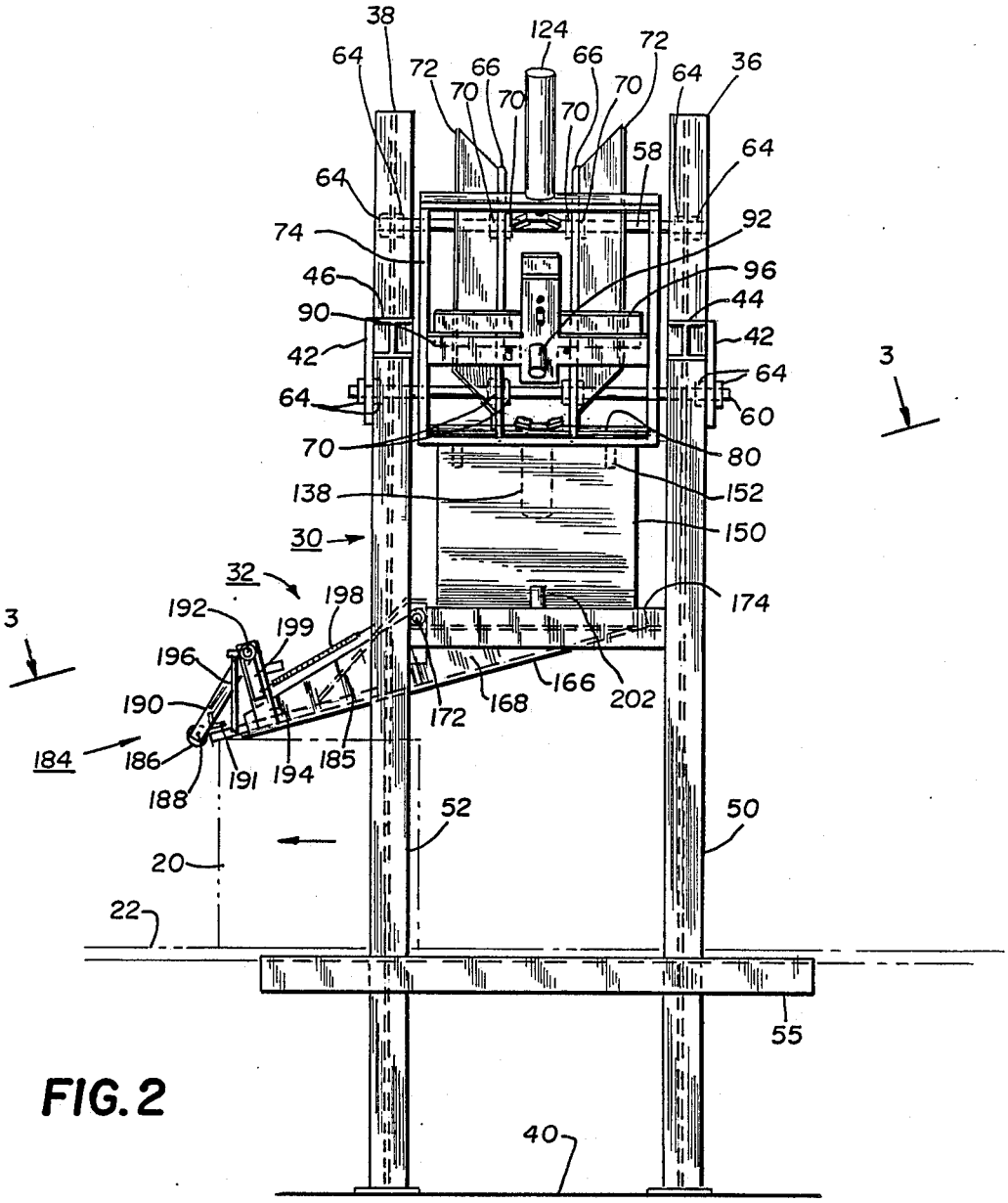
FIG. 2 represents a side elevational view of the apparatus of FIG. 1 in an enlarged scale, this view, partly diagrammatic showing the arrangement of an inclined chute for the placement of a preformed cover on a preformed container, this view taken along line 2—2 of FIG. 1.
Figure 3:
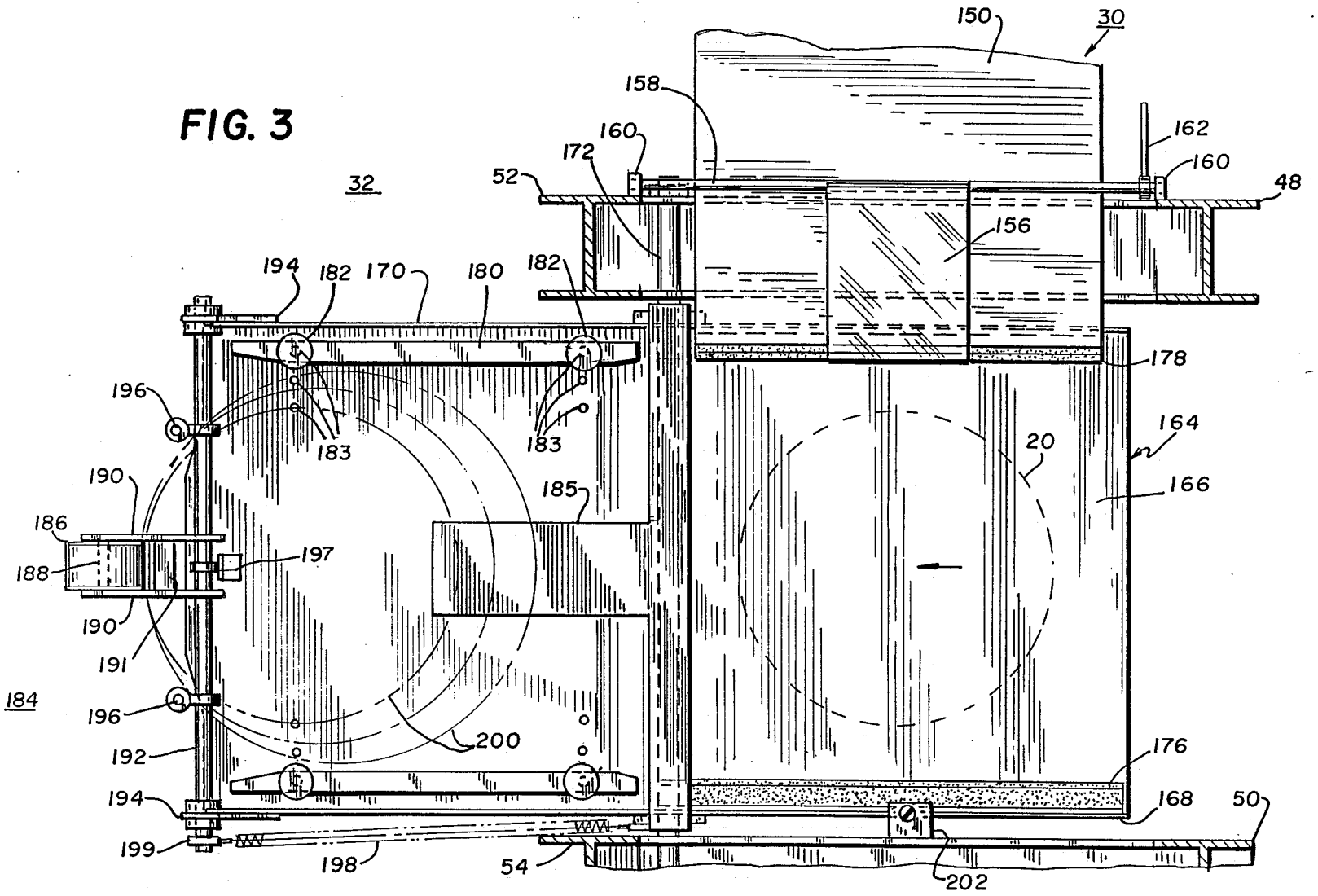
FIG. 3 represents a plan view of the inclined chute, this view partly diagrammatic, in an enlarged scale, and taken along line 3—3 of FIG. 2.

Referring now to FIGS. 2 and 3, the inclined chute and placing assembly 32 has a U-shaped chute member 164 having a substantially flat bottom portion 166, a first side 168 and a second side 170. The inclined chute 164 is pivotly mounted to welded steel frame 34, by means of an elongated shaft 172. This shaft 172 is attached to the first side member 168 and second side member 170 at a selected position. The extending ends of the shaft 172 are journaled in a pair of horizontal beams 174 of the steel frame 34.

A front bumper 176 and a rear bumper 178 are attached interior of the first side 168 and second side 170, respectively, of the inclined chute 164. A pair of side guides 180 are removably fastened to the inclined chute 164 by means of commercially available knurled head screws 182 threaded into a series of tapped holes 183. A stationary paddle 185 is mounted and fastened to sides 168 and 170 at a selected position.

A locating and placing assembly, generally identified as 184, is fastened to the discharge portion of the inclined chute 164 which extends exterior of the welded frame 34 (left side as shown). This locating and placing assembly 184 comprises a wheel member 186 journaled on a shaft 188 carried by a pair of arms 190. Each arm 190 is secured to a pivoting shaft 192. A guide angle 191 is secured to the pair of arms 190 at a selected position between the wheel 186 and the shaft 192. The shaft 192 is journaled in a pair of brackets 194, which are fastened to the first side 168 and second side 170 of the chute 164. Preferrably these brackets 194 are located at or near the discharge end of the chute 164. A pair of elongated guide rods 196 are adjustably mounted to the pivot shaft 192. These guide rods 196 extend downwardly from the shaft 192 to engage a preformed cover 200 being applied to a preformed container 20. The locating and placing assembly 184 is tensioned by a biasing means 198, such as an extension spring connected to a lever arm 199.

An adjustable stop 202 is provided to limit the amount of swing for the inclined chute and placing assembly 32 relative to the welded frame 34. It is also anticipated that shock absorbers may be necessary to control the deceleration of the pivoting action of the inclined chute and placing assembly 32.

EMBODIMENT OF FIGS. 7 AND 8

Figure 7:
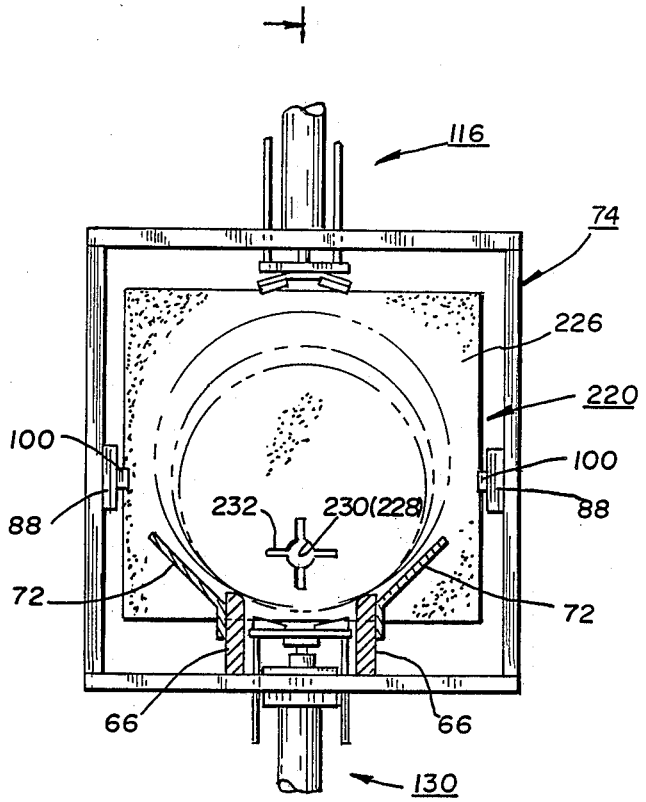
FIG. 7 represents a fragmentary sectional view, partly diagrammatic, showing an alternate embodiment for separating preformed covers from the nested stack.

Referring to FIG. 7, an alternate embodiment of a separating assembly is shown. This separating assembly employs a suction to remove and hold a first or lowermost cover from a nested stack. This assembly is otherwise similar in all respects to the previously described assembly 32. The major components include a frame assembly 74; support members 88; mounting plate 90; actuator 92; guides 100; upper clamp 116; and lower clamp 130. A cover separating member 220 comprises a plate 222 having a substantially flat face 224. The flat face 224 of the plate 222 is covered with closed cell sponge material 226. A through aperture 228 is provided at a selected position in the lower portion of the plate 222. It is to be noted that the location of aperture 228 is a matter of design choice. An aperture 230 formed in the sponge material 226 is aligned with the aperture 228 in the plate 222. A plurality of radially extending passageways 232 may be formed in the sponge material 226 if and when needed. A conduit connection 234 is provided and extends from the side of the plate 222, opposite the face 224. This conduit connection 234 provides attachment for a flexible conduit, not shown, connected to a controlled suction source.

USE AND OPERATION

Referring to FIG. 1, a machine operator places preformed covers 200 onto the radiused edges of the elongated rails 66 of the hopper assembly 26. The covers 200 are provided in nested stacks which are usually 61 cm. (24 in.) high. This hopper will preferably hold approximately 250 covers when filled. Of course the hopper may be designed for manual feeding or automatic continuous feeding. The delivery of covers to the hopper is a matter of system design. The formed side guides 72 should not touch the stack of nested covers, but act as a means to prevent any covers from accidentally falling from the hopper 26.

Referring to FIG. 4, the first rail member 66 and second rail member 68 are selectively spaced to accommodate a range of cover diameters. The correct adjustment will allow each and every diameter cover within the selected range to be feed without performing a readjusting proceedure. For the purpose of illustration, the covers will range in diameter from approximately 38 cm. to 50 cm. (15 to 19½ in.).

These sizes are illustrated by a smallest circle and a largest circle, shown in dashed outline. Each of the rails 66 and 68 are spaced approximately 9 cm. from the center of the frame 74. After the proper location of rails 66 and 68 has been determined the collars 70, seen in FIG. 2, are clamped to shafts 58 and 60. The hopper assembly 26 should preferably be at or near the center of the welded steel frame 34. As previously noted, the frame 74 is secured to the rails 66 and 68 by screws 76. The above adjustment should place the vertical centerline of the cover 200 in line with the axial center-lines of the upper and lower clamps. The incline angle of the hopper is adjusted to allow advancement of the covers 200 to the separating assembly 28.

The hopper assembly 26 preferably has a detection means for indicating when a sufficient supply of covers 200 are present in the hopper. An intermittently operated vibrator, not shown, may be mounted on the hopper at a selected position to insure that the stack of nested covers 200 advance to the separating assembly 28. It is to be noted that the covers are loaded into the hopper with the top or outside portion facing the separating assembly 28.

Figure 6A:
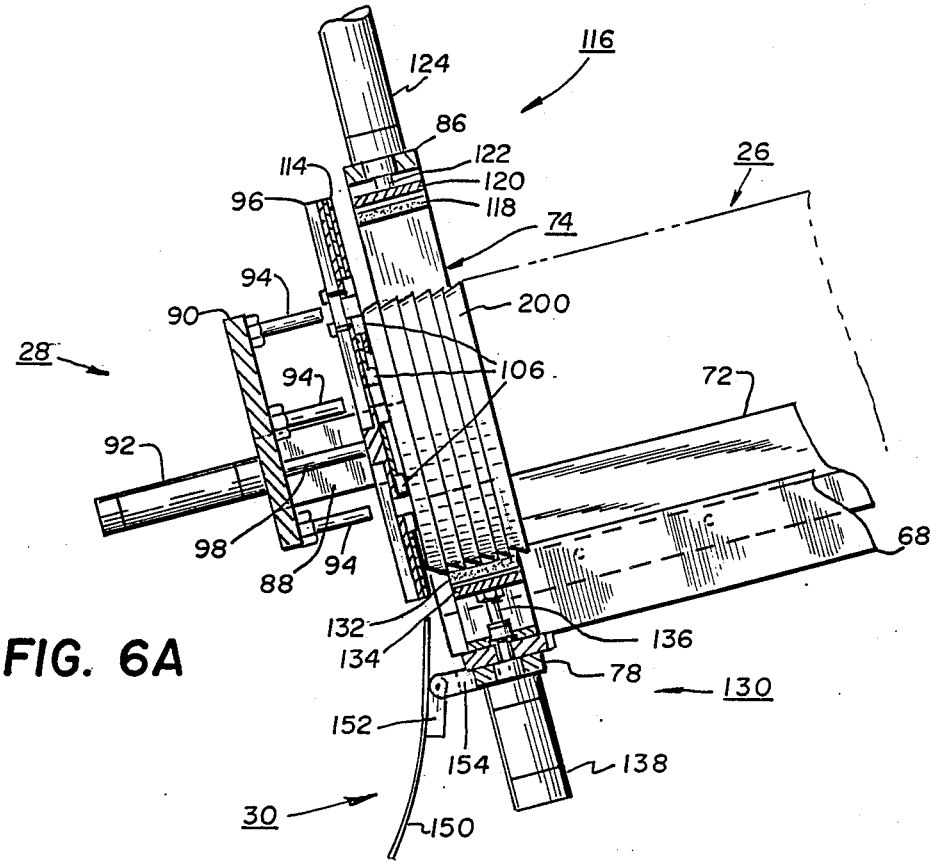
FIG. 6A represents a sectional view of the embodiment of FIG. 5, partly diagrammatic and in a reduced scale, this view showing the arrangement of the components just prior to separation of the lowermost cover from the nested stack.
Figure 6B:
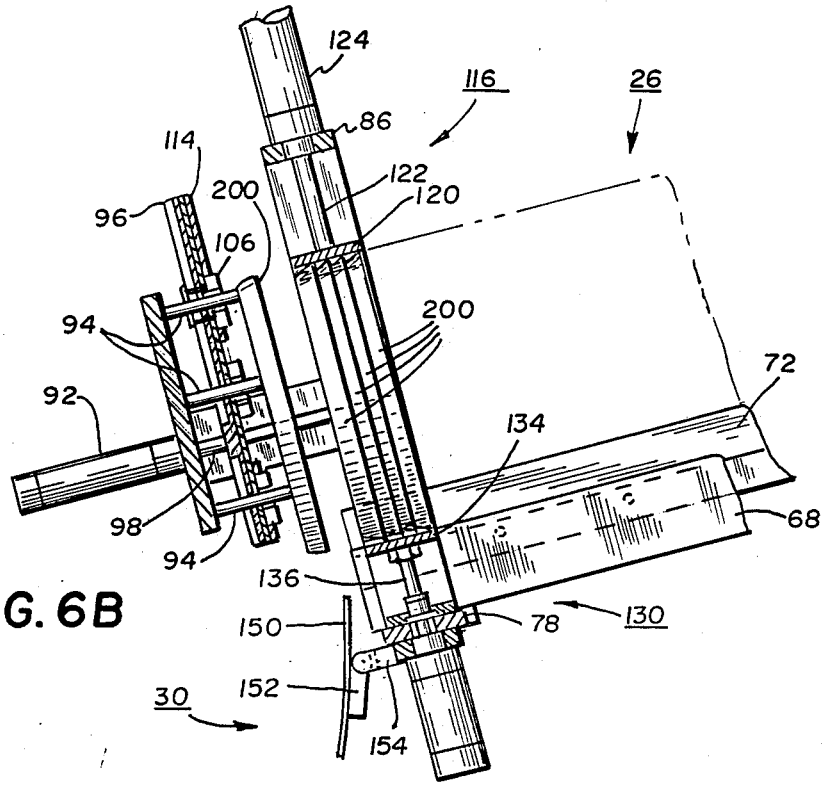
FIG. 6B represents the apparatus of FIG. 6A and showing the arrangement of components after separation of the cover from the nested stack.

Referring now to FIG. 6A, a nested stack of covers 200 are urged against the cover separating member 96 by gravity and by the intermittently operated vibrator, when and if used. The outward or rightward extent of the separating plate 96 is controlled by an adjustable stop means, not shown. The preferred adjustment places the back edge of the first or lowermost cover slightly beyond the front edge of the frame 74. The stripper pins 94 have been adjusted to provide a predetermined and substantially equal projection from the mounting plate 90. The above adjustments are made for a particular type of cover and readjustments will not be required for covers of different diameters but of the same type. It is important that the stripper pins 94 be non-ferrous to avoid holding the cover 20 by magnetized stripper pins 94.

This apparatus is designed for automatic operation as and when a cover is needed at the placing position 32. The absence or presence of a cover is detected by a sensor 197.

The operating cycle begins when the sensor 197 detects the absence of a cover 200. A signal is sent to a first control valve which extends the first linear actuator 124 for the upper clamp 116. As and when the upper clamp 116 makes contact with the second, third and fourth covers of the nested stack, a first pressure switch detects "0" PSIG line pressure in the exhausting line between the first linear actuator and the first valve. The first pressure switch signals a second control valve to extend the second linear actuator 138 for the lower clamp 130. This actuator extension results in clamping on the bottom of the nested stack by the lower clamp 130. As and when the lower clamp 130 has completed its extending movement, a second sensing means such as a second pressure switch located in the exhaust line of the second linear actuator signals a third linear actuator 92 to retract. This retracting action separates the first cover from the clamped second, third and fourth covers.

The magnets 106 attract the first or lowermost ferrous metallic cover from the nested stack. Depending on the diameter of the cover 200 the uppermost magnet 106 is either extended or retracted. As an example, the uppermost magnet 106 retract when and as a raised rim of the cover 200 comes in contact with the magnet. The uppermost magnet 106 remains extended for larger diameter covers within the selected range of covers.

Referring to FIG. 6A, the first cover 200 now held by magnets 106 is separated from the nested stack of covers in the hopper. During the leftward movement of the separator member 96, the cover 200 is stripped from the magnets 106 by stripper pins 94.

The cover 200, subsequently falls onto the vertical portion of the transfer chute assembly 30 after being stripped from the magnets 106. The cover 200 is oriented from a more or less vertical disposition to a more or less horizontal disposition by the curvature of the plate 150. A gate 156 provides a decelerating or braking action to decrease the velocity of the cover 200 as and when it falls onto the inclined chute 164.

The advancing cover 200 contacts the front bumper 176 first. Should the cover rebound sufficiently enough to hit the rear bumper 178, the gate 156 provides a stop to prevent the cover from coming to rest on the curved transfer plate 150. Gravity advances the cover 200 leftward down the inclined chute 164. Side guides 80 limit the transverse movement of the cover 200 and are usually positioned to allow the largest diameter cover to pass therethrough and into the placing position. The guide rods 196 are selectively positioned to guide all diameter covers within the selected range. The correct position, substantially centered as shown, will align the cover 200 with the preformed container 20, advancing below the inclined chute 164. Guide 191 and paddle 185 limit the lifting of the cover 200 as the inclined chute pivots during placement on the advancing container 20. The wheel 180 rolls the cover onto the container 20 for subsequent final closing or sealing. It is to be noted that the placing assembly 184 pivots in a clock-wise direction as and when the cover advances with the moving container. It is to further noted that the inclined chute is permitted to pivot a selected amount, up to 3 cm., at the discharge end, as when a container passes therethough.

Sensor 197 detects the presence of a cover and provides a signal to advance a preformed container as well as signaling the third linear actuator 92 to return to its extended position as shown in FIG. 6A. A third pressure switch located in the exhausting line of the third linear actuator detects "0" PSIG Pressure, which signals, first, the upper clamp 116, then sequentially, the lower clamp 130 to retract. Simultaneously the vibrator located on the hopper 26 is actuated for a predetermined time. This cycle of operation will continue as long as there is a sufficient supply of covers 200 in the hopper 26 and as long as there is a need to cover containers 20.

USE AND OPERATION OF THE ALTERNATE EMBODIMENT

Figure 8:
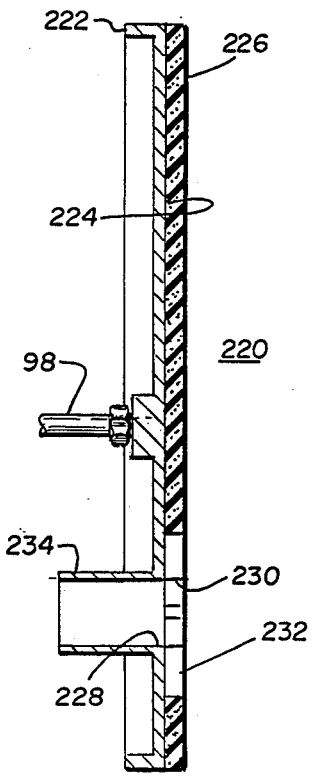
FIG. 8 represents a fragmentary sectional view, in an enlarged scale and partly diagrammatic, of the alternate embodiment, this view taken along line 8—8 of FIG. 7.
Figure 9:
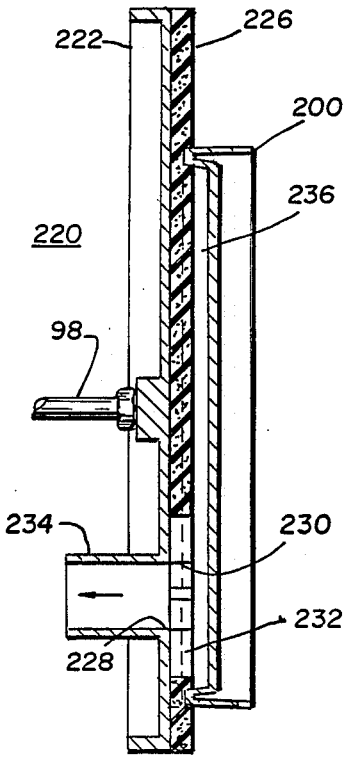
FIG. 9 represents a fragmentary sectional view of the alternate embodiment in the scale of FIG 8, this view showing a cover being held by a cover separating assembly of the apparatus.

Referring to FIGS. 8 and 9, there is shown an alternate embodiment for separating all metallic and plastic covers. The separation of the first or lowermost cover is provided by a negative pressure in the chamber 236. The source of the negative pressure is connected to the conduit connection 234, by means of a flexible conduit. The negative pressure is selectively cycled to remove the lowermost cover 20 from the nested stack of covers or release the lowermost cover onto the transfer chute 150, as and when desired. The thickness of the sponge 226 is selected to allow for the holding of distorted covers within accepted tolerable limits.

It should be noted that the automatic clamping, guiding, and placing of the covers will be substantially the same as previously described.

During the normal course of a production run of filling and covering containers it may be necessary to change from one size container to another. This change quite often requires a different diameter cover. It is in this instance that the value of the present invention becomes apparent. The change over from one size cover to the other is substantially a two step process. Step One, Remove all remaining covers of one size from the hopper. Second fill the hopper with the new covers to be feed, metered, and placed.

The preferred embodiment utilizes spacer pads 114 to compensate for variations in ferrous metal cover designs. These spacers 114 are provided in various thicknesses. It may be necessary to substitute a thicker or thinner spacer 114 as the depth of recess for the center portion of the cover varies.

The above description and associated drawings have depicted an apparatus with a left-hand placement or discharge. It is to be noted that the present invention will also satisfactorily operate with a right-hand placement or discharge.

The hopper 26 has also been shown disposed at a 90 degree angle with the direction of cover placement or discharge. It is anticipated that a hopper 26 arrayed in a substantially in-line configuration with the direction of cover placement or discharge will operate as well. The arrangement of the components is a matter of space and design considerations.

The first, second, and third linear actuators are preferably double acting pneumatic cylinders but other actuators may be substituted such as hydraulic cylinders or electro-mechanical actuators.

The magnets 106 have been shown and described as disk-type permanent magnets, but of course other shapes of permanent magnets may be used. It is also anticipated that electrically controlled electro-magnets may be used in place of the permanent magnets.

In the above description the preferred embodiment employs a first, second, and third pressure switch to detect the completion of the stroke of its associated linear actuator. These pressure switches conveniently detect the completion of motion of the linear actuators, independent of the distance traveled. The use of this type of position sensing means eliminates the need for adjustment of the position sensing means when and as different diameter covers are used. In electro-mechanical systems a means for sensing an increase of amperage in a feed line would signal the control circuit to actuate subsequent operations.

Terms such as "left", "right", "up", "Down", "bottom", "top", "front", "back", "in", "out" and the like are applicable to the embodiments shown and described in conjunction with the drawings. These terms are merely for the purpose of description and do not necessarily apply to the position in which the separating, feeding, and metering apparatus of the present invention may be employed.

While these particular embodiments of a separating, feeding, and metering apparatus have been shown and described, it is to be understood that the invention is not limited thereto and protection is sought to the broadest extent the prior art allows.

What is claimed is:

1. An improved apparatus for separating, feeding, metering, and placing of a preformed cover onto a traveling preformed container, said preformed cover being a first and lowermost cover of a nested stack, said apparatus including:

(a) a main frame assembly;

(b) an inclined hopper assembly adjustably mounted on said main frame assembly, said hopper assembly adapted for advancing said nested stack of covers towards a cover separating assembly;

(c) said cover separating assembly carried on a lowermost end of said hopper assembly, said cover separating assembly including, a frame member carrying a first clamping means, a second clamping means, and a cover separating means, said first clamp means and second clamp means sequentially actuated for retaining at least a second of the preformed covers in the nested stack, said first clamp and second clamp cooperating to retain said second cover and subsequent covers from advancing down said inclined hopper during a selected period, said cover separating means adapted to separate said first cover from said retained second cover, and said cover separating means further adapted to release said first cover at a selected time.

(d) a first sensing means for determining the clamping of a top portion of the second cover by said first clamp independent of the distance traveled by said first clamp, said determination of said first sensing means providing actuation of the second clamp, a second sensing means for determining the full clamping of a bottom portion of the second cover by the second clamp, independent of a distance traveled by the second clamp, said determination of said second sensing means providing for the actuation of the cover separating means for separating said first cover from said second cover.

(e) a transfer chute assembly carried on said frame member of the cover separating assembly, said transfer chute assembly including a curved transfer chute adapted for accepting said first cover released by said cover separating means, said curved chute adapted for rotating said first cover, advancing by gravity thereon, from a substantially vertical disposition to a substantially horizontal disposition;

(f) an elongated inclined chute pivotly mounted to said main frame assembly, said inclined chute having a first end, a discharge end, and a means for limiting the pivoting extents of the inclined chute, said first end adapted to receive said first cover advancing horizontally from said transfer chute assembly, said inclined chute adapted for advancing said first cover, by gravity, from said first end to the discharge end;

(g) a placing assembly mounted at and on said discharge end of the inclined chute, said placing assembly adapted to guide and subsequently stop advancement of said first cover in substantially centered alignment with said traveling container, said placing assembly further providing a means for engaging a leading edge of the traveling container with a mating portion of the first cover, said placing assembly further adapted for releasing said first cover onto said traveling container;

(h) said hopper assembly, said cover separating assembly, said transfer chute assembly, said inclined chute, and placing assembly adapted for an initial adjustment for a selected range of preformed cover sizes of a substantially like design; and said hopper assembly, said cover separating assembly, said transfer chute assembly, said inclined chute, and said placing assembly separating, feeding, metering, and placing any size preformed cover, within said selected range of covers, from said nested stack after and only with said initial adjustment.

2. An apparatus as recited in claim 1 further including a cover detecting sensor arrayed at the discharge end of the inclined chute, said cover detecting sensor determining an absence of a cover at said discharge end, said determination providing a signal for the automatic separation of said first cover from the nested stack.

3. An apparatus as recited in claim 2 wherein said placing assembly includes:

(a) a pair of elongated brackets fastened to said inclined chute;

(b) a pivoting shaft member journaled in each of said brackets;

(c) a pair of arms fixed to the pivoting shaft at a selected position between said brackets, said pair of arms arrayed in a selected spaced relationship;

(d) a wheel member journaled on a shaft, said shaft carried on an end of the arms distal the pivot shaft; and (e) a pair of guide rods adjustably mounted to said pivot shaft, said guide rods arrayed one each side of the pair of arms at a selected distance, each of said guide rods extending downward to engage the periphery of said first cover as and when said first cover advances on the inclined chute, engagement of said first cover by said guide rods providing said centered alignment as and when said first cover advances toward said wheel.

4. An apparatus as recited in claim 3 which further includes:

(a) a guide angle secured to said pair of arms at a selected position between the wheel and the pivoting shaft; and (b) a paddle member secured to said inclined chute, said angle guide and paddle member adapted for limiting the lifting of the first cover during the placing of the cover on the traveling container.

5. An apparatus as recited in claim 4 wherein a cover advancement path of the inclined chute is arrayed in angled alignment with a cover advancement path of the hopper assembly and transfer chute, this angled alignment providing a means for altering the direction of advancement for said horizontally disposed cover.

6. An apparatus as recited in claim 5 wherein the inclined chute assembly further includes:

(a) an elongated U-shaped chute member having a substantially flat bottom portion, an upwardly extending first side member, and an upwardly extending second side member;

(b) a first bumper mounted interior of said first side member of the inclined chute, said first bumper located at or near the first end of the discharge chute;

(c) a rear bumper mounted interior of said second side of the inclined chute, said rear bumper located at or near the first end of the inclined chute, said first bumper and rear bumper for absorbing the impact energy from the advancing cover; and (d) a pair of elongated side guide members selectively positioned and removably mounted to the flat bottom portion of the inclined chute, each of said guide members arrayed for guiding the largest cover of said range of covers advancing thereon and therethrough.

7. An apparatus as recited in claim 6 wherein the transfer chute assembly further includes:

(a) a shaft pivotly mounted to said main frame assembly;

(b) a gate member attached to said shaft;

(c) a biasing means for applying a determined force to a free end of the gate, said gate acting as a decelerating means for the advancing cover for limiting a rebounding of the first cover from the first bumper, and said gate further providing a stop means for preventing any rebounding cover from coming to rest on the transfer chute.

8. An apparatus as recited in claim 2 wherein said first clamp means includes:

(a) a first linear actuator adapted for advancing its associated rod member when and as desired;

(b) a first shaped elastomer pad carried on a backing plate, said backing plate removably secured to an advancing end of said rod member of the first actuator, said first elastomer pad adapting to the contour of any covers being clamped; and (c) an anti-rotation means for maintaining a preferred alignment of the first shaped elastomer pad with the nested stack of covers.

9. An apparatus as recited in claim 8 wherein said second clamp means further includes:

(a) a second linear actuator adapted for advancing its associated rod member when and as desired;

(b) a second shaped elastomer pad carried on a lower backing plate, said lower backing plate removably secured to an advancing end of said rod member of the second actuator, said second elastomer pad adapting to the contour of any covers being clamped; and (c) an anti-rotation means for maintaining a preferred alignment of the shaped elastomer pad of the second clamp with the nested stack of covers.

10. An apparatus as recited in claim 9 wherein said cover separating means includes:

(a) a third linear actuator carried on a stationary mounting plate of said frame, said third actuator adapted for advancing its associated rod member as and when desired;

(b) A cover separating member removably secured to the an advancing end of the rod member of the third actuator, said cover separating member adapted for separating said first cover from the nested stack and releasing said cover at a predetermined time during a retraction of said rod member; and (c) an anti-rotation means for maintaining said cover separating member in a preferred alignment with said nested stack of covers.

11. An apparatus as recited in claim 10 wherein said cover separating means further includes:

(a) a plurality of elongated stripper pins mounted on and in said stationary mounting plate, said stripper pins arrayed for projecting, a selected distance from said stationary mounting plate, and in a direction towards said first cover in the nested stack;

(b) a plurality of apertures positioned in and through said cover separating member, said apertures arrayed in substantial alignment with said stripper pins, said apertures further adapted for the free passage of its associated stripper pin therethrough;

(c) a plurality of magnets secured to said cover separator member, said magnet adapted for attracting and holding the first cover of a nested stack of ferrous metal covers, and said plurality of stripper pins adapted for releasing said first cover from said plurality of magnets onto said transfer chute assembly.

12. An apparatus as recited in claim 11 wherein said plurality of magnets are permanent magnets.

13. An apparatus as recited in claim 12 wherein said permanent magnets are disk shaped with a central aperture therethrough, said central aperture adapted for the passage of said stripper pins therethrough.

14. An apparatus as recited in claim 13 which further includes:

(a) at least one retracting magnet; and (b) a biasing means for said retracting magnet, said biasing means allowing the extension of the retracting magnet to a selected position, said biasing means allowing further for retraction of the retracting magnet when acted upon by a raised portion of said first cover.

15. An apparatus as recited in claim 10 wherein said cover separating member includes:

(a) a plate member having at least one major substantially flat surface; said flat surface facing said first cover in the nested stack;

(b) a first aperture selectively positioned in and through said plate member;

(c) a resilient sponge member bonded to and covering said flat face;

(d) a second aperture provided in and through said resilient sponge member, said second aperture substantially aligned with said first aperture;

(e) a means for attaching a flexible conduit to the plate member, said flexible conduit attached at its opposite end to a selectively cycled source of suction, said suction for separating and holding said first cover adjacent said resilient sponge member for a selected period of time, said sponge providing a sealing means between the cover and the plate member.

16. An apparatus as recited in claim 10 wherein the hopper assembly further includes:

(a) a pair of elongated rail members for supporting the nested stack of covers, said elongated rail members being mounted in substantially parallel spaced relationship; and (b) an elongated formed side guide mounted to an exterior surface of each elongated rail member, said formed side guide allowing for the advancement of the nested stack while preventing an unwanted escapement of any covers from said nested stack.

17. An apparatus as recited in claim 16 wherein a surface of each of said elongated rails contacting said nested stack is radiused, said radiused surface providing for the smooth advancement of the nested stack of covers.

18. An apparatus as recited in claim 17 wherein said hopper assembly further includes a cover sensing means for determining the presence of a sufficient quantity of covers in the nested stack, this determination allowing for continued automatic and cyclic operation of said apparatus.

19. An apparatus as recited in claim 18 wherein said hopper assembly further includes an intermittently operating vibrator for assisting in the advancement of the covers towards the cover separating assembly.

20. An apparatus as recited in claim 16 wherein said cover separating means further includes:

(a) a plurality of elongated stripper pins mounted on and in said stationary mounting plate, said stripper pins arrayed for projecting, a selected distance from said stationary mounting plate, and in a direction towards said first cover in the nested stack;

(b) a plurality of apertures positioned in and through said cover separating member, said apertures arrayed in substantial alignment with said stripper pins, said apertures further adapted for the free passage of its associated stripper pin therethrough;

(c) a plurality of magnets secured to said cover separator member, said magnet adapted for attracting and holding the first cover of a nested stack of ferrous metal covers, and said plurality of stripper pins adapted for releasing said first cover from said plurality of magnets onto said transfer chute assembly.

21. An apparatus as recited in claim 20 wherein said plurality of magnets are permanent magnets.

22. An apparatus as recited in claim 21 wherein said permanent magnets are disk shaped with a central aperture therethrough, said central aperture adapted for the passage of said stripper pins therethrough.

23. An apparatus as recited in claim 22 which further includes:

(a) at least one retracting magnet; and (b) a biasing means for said retracting magnet, said biasing means allowing the extention of the magnet to a selected position, said biasing means allowing further for retraction of the magnet when acted upon by a raised portion of said first cover.

24. An apparatus as recited in claim 16 wherein said cover separating member includes:

(a) a plate member having at least one major substantially flat surface; said flat surface facing said first cover in the nested stack;

(b) a first aperture selectively positioned in and through said plate member;

(c) a resilient sponge member bonded to and covering said flat face;

(d) a second aperture provided in and through said resilient sponge member, said second aperture substantially aligned with said first aperture;

(e) a means for attaching a flexible conduit to the plate member, said flexible member attached at its opposite end to a selectively cycled source of suction, said suction for separating and holding said first cover for a selected period of time, said sponge member providing a sealing means between the cover and the flat surface of the plate member.

* * * * *